US007347146B1

(12) United States Patent
Gieseke

(10) Patent No.: US 7,347,146 B1
(45) Date of Patent: Mar. 25, 2008

(54) SUPERCAVITATING PROJECTILE WITH PROPULSION AND VENTILATION JET

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 336 days.

(21) Appl. No.: 11/116,170

(22) Filed: Apr. 25, 2005

(51) Int. Cl.
*F42B 15/20* (2006.01)
*F42B 15/22* (2006.01)

(52) U.S. Cl. ..... 102/399; 102/341; 102/374; 102/381; 114/20.1; 114/20.2

(58) Field of Classification Search ..... 114/20.1, 114/20.2; 102/341, 374, 381, 399
See application file for complete search history.

(56) References Cited

U.S. PATENT DOCUMENTS

| | | | | | |
|---|---|---|---|---|---|
| 1,546,282 | A * | 7/1925 | Chase et al. | ..... | 114/20.1 |
| 2,411,393 | A * | 11/1946 | Smith | ..... | 114/20.1 |
| 2,706,957 | A * | 4/1955 | Hughes | ..... | 114/20.1 |
| 3,205,846 | A * | 9/1965 | Lang | ..... | 114/67 A |
| 4,186,679 | A | 2/1980 | Fabula et al. | | |
| H684 | H | 10/1989 | Arszman et al. | | |
| 5,070,761 | A | 12/1991 | Fidler | | |
| 5,425,301 | A | 6/1995 | Kriebel | | |
| 5,955,698 | A * | 9/1999 | Harkins et al. | ..... | 102/399 |
| H1938 | H * | 2/2001 | Harkins et al. | ..... | 102/399 |
| 6,405,653 | B1 * | 6/2002 | Miskelly | ..... | 102/374 |
| 6,684,801 | B1 * | 2/2004 | Kuklinski | ..... | 114/67 A |
| 6,739,266 | B1 * | 5/2004 | Castano et al. | ..... | 102/399 |
| 6,849,247 | B1 * | 2/2005 | Wagaman et al. | ..... | 423/657 |

OTHER PUBLICATIONS

Federation of American Scientists, BA-111 Shkval Underwater Rocket, Sep. 3, 2000, http://web.archive.org/web/20001024221110/http://fas.org/man/dod-101/sys/missile/row/shkval:htm.*

Federation of American Scientists, BA-111 Shkval Underwater Rocket (Figure 1), Sep. 3, 2000, http://web.archive.org/web/20011109161020/fas.org/man/dod-101/sys/missile/row/Shkval-1.jpg.*

* cited by examiner

*Primary Examiner*—Andrew J. Fischer
*Assistant Examiner*—Jamie Kucab
(74) *Attorney, Agent, or Firm*—James M. Kasischke; Michael P. Stanley; Jean-Paul A. Nasser

(57) ABSTRACT

A supercavitating projectile is disclosed and includes a combustion chamber, a forward-directed jet nozzle and a comparatively larger gas duct/rear-directed jet nozzle. The combustion chamber is filled with a propellant having a hollowed core. The core serves as a pathway to fluidly allow combustion gases to the jet nozzles. In operation, the propellant combusts to form gasses forced forward through the forward-directed nozzle to generate a virtual cavitator in the form of a ventilation gas bubble. Combusted gasses are also forced out the rear-directed nozzle forming a propulsion jet. The projectile therefore uses the rear-directed jet to maintain a cruise velocity approximate to the launch velocity and employs a source of ventilation gas using the forward-directed jet for supercavitating of the projectile.

6 Claims, 2 Drawing Sheets

SUPERCAVITATING PROJECTILE WITH PROPULSION AND VENTILATION JET

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an underwater projectile that incorporates a ventilation gas jet emitting from a tip of the underwater projectile and a propellant gas jet emitting from a rear of the projectile. The gas jets are produced in a combustion chamber in which the forward-directed ventilation gas jet produces a virtual cavitator to form a gas bubble around the projectile body and the comparatively larger rear-directed propellant gas jet nozzle acts a propellant for the projectile and allows the gas bubble to act as a supercavitator by the moving direction of the projectile.

(2) Description of the Prior Art

Presently, research is ongoing for the use of underwater gun systems as anti-mine and anti-torpedo devices. An underwater gun system is typically composed of a magazine of underwater projectiles, an underwater gun, a ship-mounted turret, a targeting system, and a combat system.

Specifically, the targeting system identifies and localizes an undersea target. The combat system provides the control commands to direct the ship-mounted turret to point the underwater gun towards the undersea target. The underwater gun shoots the underwater projectiles in which the underwater gun is designed for neutralization of undersea targets at relatively long range (200 m for example).

Projectiles fired from underwater guns can effectively travel long distances by making use of supercavitation. A typical supercavitating projectile 10 is depicted in FIG. 1. Supercavitation occurs when the projectile 10 travels through water at very high speeds and a vaporous cavity 12 forms at a tip 14 of the projectile. With proper design, the vaporous cavity 12 can envelop an entire projectile. Because the projectile 10 is not in contact with the water (excluding at the tip 14 and occasional collisions with the cavity wall, "tail slap"), the viscous drag on the projectile is significantly reduced over a fully wetted operation.

Current projectiles lack propulsion in that the projectiles are instead launched from a gun at high speeds (of the order of 1000 meters/second). The projectiles decelerate as they travel downrange toward their targets, striking their target at velocities typically of 500 meters/second.

It is possible to reduce the velocity needed for launch if the projectile is provided with an on-board propulsion system and/or a drag reduction system. If a simple propulsion system is provided, the gun can launch the projectiles at their cruise velocity (desired impact velocity) and the propulsion system can maintain and carry the projectile to its target at approximately the cruise velocity.

A related issue in projectile operation is the problem of speed and depth dependency of a generated cavity. At launch, a cavity is formed, the size of which is a function of the projectile speed and the cavitator size. As the projectile begins to travel down-range, the projectile begins to slow down due to the drag generated at the tip of the projectile and the cavity, that the projectile generates, shrinks. The cavity continues to shrink as the projectile decelerates until the cavity can no longer envelop the entire projectile.

Pressure also influences the size of the cavity. The size of the cavity is inversely proportional to the ambient pressure. Consequently, projectiles cannot travel as far when deep beneath the ocean surface as the projectiles can travel at very shallow depths.

The high ambient pressure of deep ocean depths can be compensated through the injection of gas into the cavity. If gas is forced into the normally vaporous cavity, the internal pressure of the cavity increases and the cavity grows.

It has been demonstrated that forward-directed jets from moving vehicles can produce supercavities in a manner similar to a physical cavitator. The jet advances forward of the vehicle to where a moving front is produced. The size and shape of the cavity are related to the diameter of the forward-directed jet and the speed of the advancement of the front.

Empirical relations, can be used to determine the size of a cavity produced by a disc cavitator. The cavity shape is assumed to be elliptical as defined by $$\left(\frac{x-l/2}{l/2}\right)^m+\left(\frac{r}{R}\right)^n=1, \tag{1}$$

where x is the distance along the cavity axis, l is the length of the cavity, r is the cavity radius, and R is the maximum cavity radius. The exponents are selected as m=2 and n=2.4. Two other parameters are required to define the cavity shape: $\lambda(\sigma)$ and $\mu(\sigma, C_D)$. $C_D$ is the cavitator drag coefficient based on the cavitator projected area and $\sigma$ is the cavitation number defined as $$\sigma=\frac{P_\infty-P_c}{l/2\rho U^2} \tag{2}$$

where $\rho$ is the fluid density, $P_\infty$ is the ambient pressure, $P_c$ is the cavity pressure, and U is the projectile speed. The first parameter, the ratio of the maximum cavity diameter to cavitator tip diameter ratio is given by $$\mu=\sqrt{\frac{C_D(l+\sigma)}{\sigma(1-0.132\sigma^{1/7})}} \tag{3}$$

The second parameter, the cavity slenderness ratio, 1/2R, is given by $$\lambda=1.067\sigma^{-0.658}-0.52\sigma^{0.465} \tag{4}$$

The drag coefficient of a disc cavitator is assumed equal to 0.814.

An equivalence is assumed between a jet and a disc. A forward jet cavitator of known cross-sectional area will produce a cavity equivalent in size and characteristic to a disc a fraction of the size. The long supercavity can be formed by the jet. The cavity form will be in accordance with the cavity formed by equivalent disk size if the jet section area is S and the disk area is $S_c$, the correlation $S_c$=0.205 S will be satisfied. As such, an improvement in a cavitating-type projectile is to provide a projectile which provides propulsion to maintain a cruise velocity of the projectile while also providing a forwarded-directed jet for supercavitation of the projectile during travel.

SUMMARY OF THE INVENTION

It is therefore a general purpose and object of the present invention to provide a projectile which has an extended range.

It is a further object of the present invention to provide a projectile that can maintain a cruise velocity approximate to the launch velocity.

It is a still further object of the present invention to provide a projectile that employs a source of ventilation gas using a forward-directed jet for cavitating of the projectile.

It is a still further object of the present invention to provide a projectile that can use a rear-directed jet to maintain a cruise velocity approximate to the launch velocity and employ a source of ventilation gas using a forward-directed jet for supercavitating of the projectile.

To attain the objects described above, there is provided a supercavitating projectile capable of being launched by an underwater gun. The projectile comprises a combustion chamber, a gas duct/forward-directed jet nozzle and a comparatively larger gas duct/rear-directed jet nozzle. The combustion chamber is filled with a propellant having a hollowed core. The core serves as a pathway to fluidly allow combustion gases to the jet nozzles.

In operation, the propellant is combusted and the combusted gasses are forced forward through the forward-directed nozzle as a forward-directed jet to generate a virtual cavitator in the form of a ventilation gas bubble. Almost instantaneously combusted gasses are forced out rear-directed nozzle, forming a propulsion jet. Because of the larger volume of the rear-directed nozzle in comparison to the forward-directed nozzle, a larger amount of combusted gas is forced thru the rear-directed nozzle with the resulting force equilibrium on the projectile. The resulting force equilibrium allows the projectile to cruise forward without decelerating and to maintain a supercavitating action with the ventilation gas bubble.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
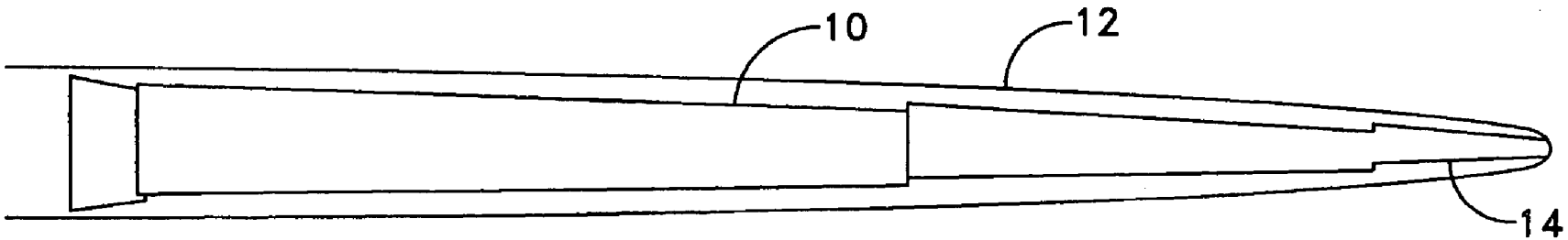
FIG. 1 (PRIOR ART)
FIG. 1 depicts a side view of a prior art supercavitating projectile.
Figure 2:
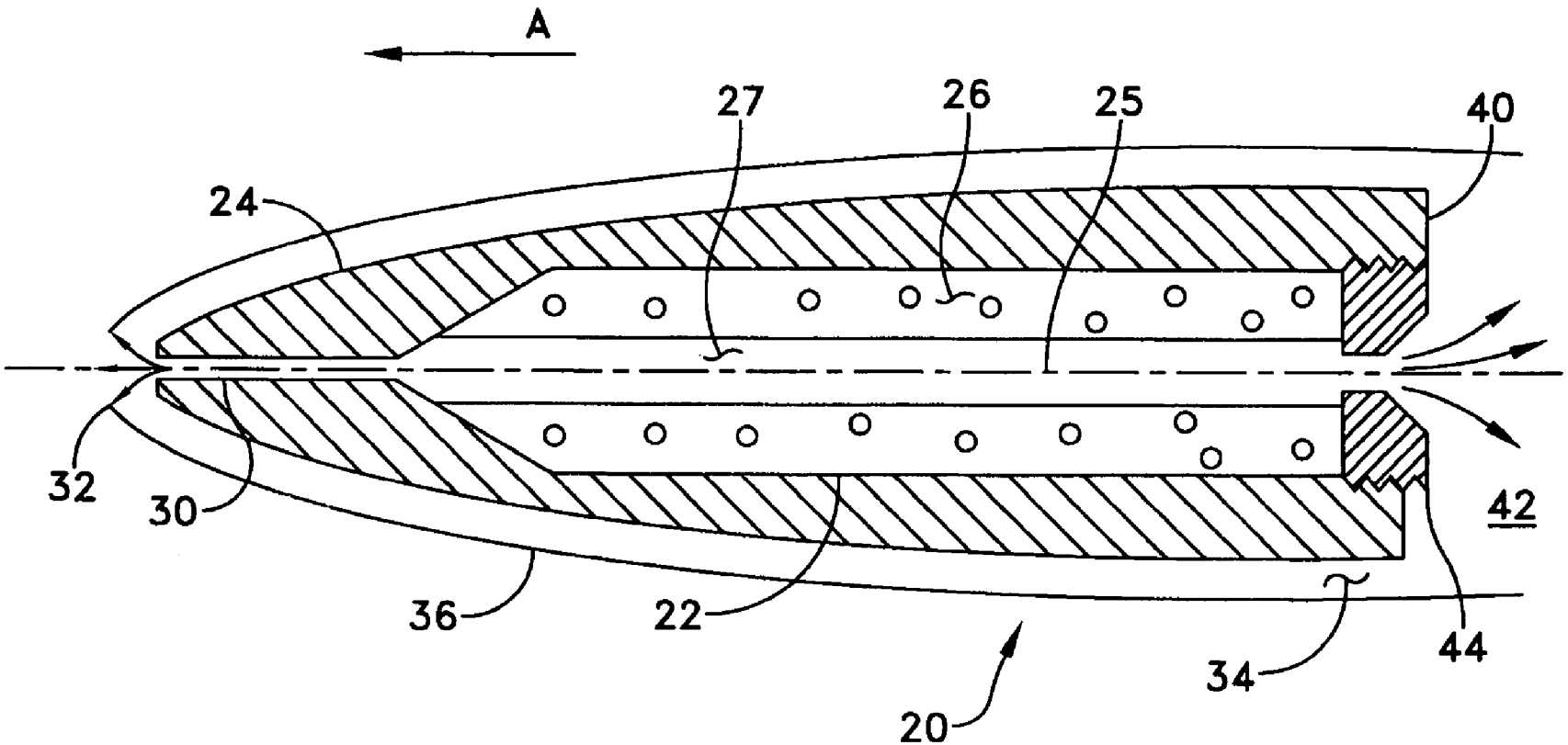
FIG. 2 depicts a side cross-sectional view of the supercavitating projectile of the present invention.

Referring now to FIG. 2, a supercavitating projectile 20 of the present invention is shown. The projectile 20 is capable of being launched by an underwater gun of a type known to those skilled in the art. The projectile 20 generally comprises a combustion chamber 22, a gas duct/forward-directed jet nozzle 30 and a comparatively larger gas duct/rear-directed jet nozzle 40.

The combustion chamber 22 is machined into a body 24 of the supercavitating projectile 20, preferably with an axis collinear to a longitudinal axis 25 of the projectile.

The combustion chamber 22 is filled with a solid propellant 26 having a hollowed core 27. The core 27 serves as a pathway to fluidly allow combustion gases to the jet nozzle 30 and the jet nozzle 40.

In operation, the propellant 26 is combusted and the combusted gasses are forced forward through the jet nozzle 30 as a forward-directed jet 32 to generate a virtual cavitator in the form of a ventilation gas bubble 34. This ventilation gas bubble 34 and the motion of gas within the ventilation gas bubble prevent contact between the body 24 and a gas-water boundary 36.

Almost instantaneously and sometimes simultaneously, combusted gasses are forced out the back of the combustion chamber 22 thru the jet nozzle 40, forming a propulsion jet 42. Because of the larger volume of the jet nozzle 40 in comparison to the jet nozzle 30, a larger amount of combusted gas is forced thru the jet nozzle 40 with the resulting force equilibrium on the body 24. The resulting force equilibrium allows the projectile 20 to cruise forward (direction "A') without decelerating and to maintain a supercavitating action with the ventilation gas bubble 34. The resulting force requires a slight excess of combusted gas from the combustion chamber 22 to compensate for gaseous drag from the flow of gas within the ventilation gas bubble 34 over the body 24.

The described combusted gas generation of the projectile 20 has the following advantages:

1) Gas injection from the combustion chamber 22 via the jet nozzle 30 into the ventilation gas bubble 34 (as a cavitator) allows the projectile to operate at a lower speed than without gas injection.
2) The gas injection allows the projectile 20 to minimize the ventilation gas bubble 34 (as a cavitator) with low drag.
3) The gas injection allows the projectile 20 to operate at deep depths.
4) Gas dynamics inside the ventilation gas bubble 34 between the projectile 20 and the gas-water boundary 36 may enhance stability of the projectile thus reducing drag.
5) Propulsion gas for the propulsion jet 42 and ventilation gas for the forward-directed jet 32 are produced from the propellant 26 of the one combustion chamber 22.

There are a few alternate configurations which can be included as part of the projectile 20. Fins in configurations, known to those skilled in the art, may be added to the body 24 of the projectile to enhance stability characteristics. Furthermore, a timing delay, known to those skilled in the art may be incorporated to allow the projectile 20 to decelerate at a predetermined time to a cruise velocity after launch before ignition by the timing delay of the propellant 26 in the combustion chamber 22. Also, a removable chamber closure 44 may be added to vary the flow of the propulsion jet 42 when testing the projectile 20 or to allow the projectile to be reusable by replacing expended propellant 26.

The foregoing description of the preferred embodiment of the invention has been presented for purposes of illustration and description only. It is not intended to be exhaustive nor to limit the invention to the precise form-disclosed; and obviously many modifications and variations are possible in light of the above teaching. Such modifications and variations that may be apparent to a person skilled in the art are intended to be included within the scope of this invention as defined by the accompanying claims.

What is claimed is:

1. A supercavitating projectile comprising:

a body having a forward end and a rear end;

a combustion chamber interior to said body;

a solid propellant loaded within said combustion chamber;

a pathway defined through said solid propellant wherein said pathway has an axis collinear to a longitudinal axis of said body;

a first nozzle with a fluid connection collinear to said pathway and to an exterior of said projectile at the forward end; and a second nozzle with a flow area larger than said first nozzle with said second nozzle having a fluid connection collinear to said pathway and to the exterior of said projectile at the rear end;

wherein said propellant is combustible to produce gases that fluidly direct through said first nozzle to form a ventilation bubble forward of said projectile and producing gases that fluidly direct through said second nozzle to form a jet as a propellant to said projectile allowing the formed ventilation bubble by said projectile to act as a supercavitator for said projectile.

2. The projectile in accordance with claim 1 wherein said projectile is capable of being launched from an underwater gun.

3. The projectile in accordance with claim 2 said projectile further comprising a timing delay within said body, said timing delay timed to control an ignition of said propellant based on a predetermined time after a launch of said projectile.

4. The projectile in accordance with claim 3 the projectile further comprising a removable chamber closure positioned within said second nozzle, said chamber closure capable of varying the flow of the gasses that fluidly direct thru said second nozzle.

5. The projectile in accordance with claim 1 further comprising a timing delay within said body, said timing delay timed to control an ignition of said propellant based on a predetermined time after a launch of said projectile.

6. The projectile in accordance with claim 5 the projectile further comprising a removable chamber closure positioned within said second nozzle, said chamber-closure capable of varying the flow of the gasses that fluidly direct thru said second nozzle.

* * * * *